US009279605B2

(12) United States Patent
Förster et al.

(10) Patent No.: US 9,279,605 B2
(45) Date of Patent: Mar. 8, 2016

(54) CONDENSER

(71) Applicant: Behr GmbH & Co. KG, Stuttgart (DE)

(72) Inventors: Uwe Förster, Erdmannhausen (DE); David Guillaume, Rochester, MI (US); Martin Kaspar, Fellbach (DE); Matthias Jung, Stuttgart (DE); Christoph Walter, Stuttgart (DE); Ottokar Kunberger, Korntal-Münchingen (DE); Andreas Kemle, Tamm (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 308 days.

(21) Appl. No.: 13/963,441

(22) Filed: Aug. 9, 2013

(65) Prior Publication Data

US 2014/0041411 A1 Feb. 13, 2014

(30) Foreign Application Priority Data

Aug. 9, 2012 (DE) ..... 10 2012 214 215
Dec. 10, 2012 (DE) ..... 10 2012 222 664

(51) Int. Cl.
*F25B 39/04* (2006.01)
*F25B 43/00* (2006.01)

(52) U.S. Cl.
CPC ..... *F25B 43/003* (2013.01); *F25B 39/04* (2013.01); *F25B 2339/0441* (2013.01)

(58) Field of Classification Search
CPC ... F25B 39/04; F25B 40/02; F25B 2339/0441
USPC ..... 62/474, 509, 473, 478, 525; 165/173, 165/181
See application file for complete search history.

(56) References Cited

U.S. PATENT DOCUMENTS

| | | | | |
|---|---|---|---|---|
| 5,531,268 | A * | 7/1996 | Hoshino et al. | 165/153 |
| 6,349,562 | B1 * | 2/2002 | Kaspar et al. | 62/475 |
| 6,446,463 | B2 * | 9/2002 | Bernini | 62/473 |
| 6,546,999 | B1 * | 4/2003 | Dienhart et al. | 165/150 |
| 7,832,230 | B2 * | 11/2010 | Feldhaus et al. | 62/509 |
| 2010/0147019 | A1 * | 6/2010 | Kaspar et al. | 62/474 |

* cited by examiner

*Primary Examiner* — Melvin Jones
(74) *Attorney, Agent, or Firm* — Paul D. Strain, Esq.; Strain & Strain PLLC

(57) ABSTRACT

The invention relates to an insert for a collector of a condenser, having a main body with a sealing lip for abutment against the inner wall of the collector axially between the two flow transfer openings of the collector, having a filter element for the fluid to flow through, having a fluid diverting element, and having a fluid duct such that the fluid diverting element diverts the radially inflowing fluid stream into an axially flowing fluid stream, and the fluid duct conducts the diverted fluid flow to the filter.

10 Claims, 3 Drawing Sheets

CONDENSER

TECHNICAL FIELD

The invention relates to an insert for a condenser, having a collector, in particular as per the preamble of Claim 1. The invention also relates to a condenser of said type.

Prior Art

Condensers for refrigerant circuits for air-conditioning systems are known in the prior art. Here, condensers having a tube-fin block with collecting tubes arranged laterally on the tube-fin block are known in which the ends of the tubes of the tube-fin block are received in a sealed manner in openings of the collecting tubes. Condensers are also known in which a collector is arranged adjacent to one of the collecting tubes. Said collector is fluidically connected to the adjacent collecting tube via two flow transfer openings. Here, between the two flow transfer openings, the collecting tube has a partition such that the inflow-side flow transfer opening is connected to a condensing region of the condenser, and the outflow-side flow transfer opening is connected to a supercooling region.

This has the effect that, when the collector is filled, the supercooling region is filled completely with condensed refrigerant, with the result of stable supercooling. Only when the fill level of the collector falls below the flow transfer opening to the supercooling region is the supercooling of the refrigerant reduced.

The collector volume also yields a phase separation between the vaporous refrigerant and the liquid refrigerant if the refrigerant is not completely condensed in the condensing region. For this purpose, the vaporous refrigerant rises in the collector and collects in the upper collector volume, whereas the liquid refrigerant collects in the lower collector volume.

In the case of modern refrigerants, however, it may be the case that the phase separation between the vaporous refrigerant and the liquid refrigerant takes place very slowly owing to only small differences in density, such that vaporous refrigerant also passes through the refrigerant flow into the supercooling region. This reduces the supercooling action because the extraction of energy leads not to supercooling but rather to condensation of the vaporous refrigerant. Overall, therefore, a reduced mean supercooling action is attained.

PRESENTATION OF THE INVENTION, PROBLEM, SOLUTION, ADVANTAGES

The problem addressed by the invention is that of providing an insert for a condenser having a collector and providing a condenser having an insert of said type in the collector, which insert is simple and inexpensive to produce and nevertheless results in good supercooling of the refrigerant in the condenser.

The problem is solved by means of the features of claim 1, according to which there is provided an insert for a collector of a condenser, having a main body with a sealing lip for abutment against the inner wall of the collector axially between the two flow transfer openings of the collector, having a filter element for the fluid to flow through, having a fluid diverting element, and having a fluid duct such that the fluid diverting element diverts the radially inflowing fluid stream into an axially flowing fluid stream, and the fluid duct conducts the diverted fluid flow to the filter.

Here, it is expedient if the fluid diverting element is in the form of a tubular element which diverts the fluid stream by way of its outer circumference and which forms the fluid duct in the radially inner region of the tubular element. In this way, it is possible in a space-saving manner for the inflow into the collector to take place radially at the outside and for the conduction to the outlet-side flow transfer opening to take place radially at the inside.

Furthermore, it is expedient if the fluid stream flows in a different direction radially at the outside at the tubular element than radially at the inside in the tubular element. This yields a flow path length which is doubled in relation to the length of the fluid diverting element, such that in this way an improved separation of the vaporous fluid and of the liquid fluid can take place.

It is also expedient if, on the tubular element, on the outer circumference thereof, there is provided a contour, which is of arcuate section, for flow diversion. By means of the arcuate contour, in particular in the form of a concave contour, the fluid stream is diverted through approximately 90° from an inflow in a radial direction into an axial flow within the collector.

It is also advantageous if the insert also has a supporting structure which bears a dryer vessel. A pouch or a cage may be provided as a dryer vessel. The pouch is advantageously produced from a plastics material such as a nonwoven. As a cage, there may be provided a plastics cage with openings for the fluid to flow through, wherein the openings are nevertheless so small that granular dryer material is thereby retained.

It is also expedient if the supporting structure is formed by struts which protrude from the tubular element in the axial direction and which are connected by a connecting means. In this way, a slim, dome-like construction is attained which can bear and/or serve as a spacer for the dryer vessel.

Here, it is expedient if the connecting means is an open ring, a cross or a plate. This has the effect that the dryer vessel can be borne securely such that it is not displaced in the direction of the fluid duct and cannot thereby obstruct or block said fluid duct.

It is also expedient if the insert can be or is connected to a closure plug of the collector. In this way, the insert can be mounted together with the closure plug, which facilitates the production of the condenser.

The problem with regard to the condenser is solved by means of the features of claim 9, according to which there is provided a condenser having a tube-fin block with tubes and fins, having collecting pipes arranged at both sides of the tube-fin block, wherein tube ends of the tubes are received in a sealed manner in openings of the collecting tubes, wherein a collector is arranged adjacent to one of the collecting tubes, and the collector is fluidically connected to the adjacent collecting tube via flow transfer openings, wherein an insert as described above is arranged in the collector.

It is also expedient if, furthermore, a vessel with a drying agent is arranged in the collector.

Further advantageous embodiments are described by the following description of the figures and by the subclaims.

BRIEF DESCRIPTION OF THE DRAWINGS

The invention will be explained in more detail below on the basis of at least one exemplary embodiment and with reference to the drawings, in which.

PREFERRED EMBODIMENT OF THE INVENTION

Figure 1:
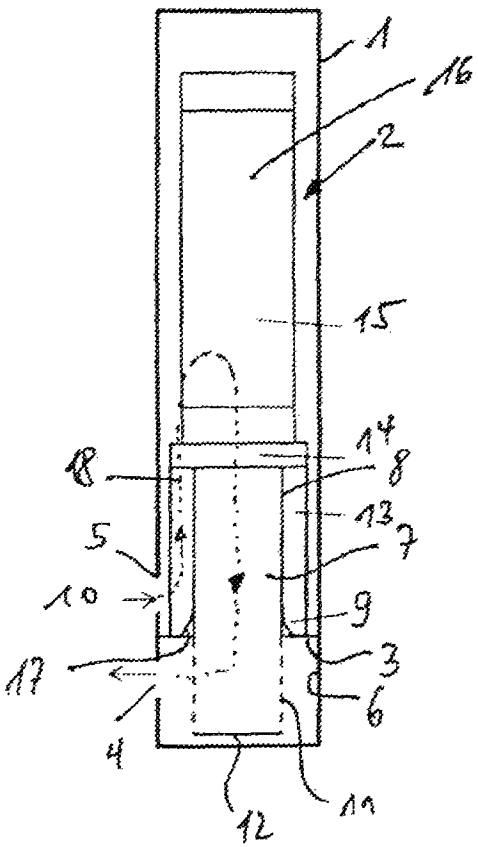
FIG. 1 shows a schematic view of a collector of a condenser with an insert.

FIG. 1 shows a schematic view of a collector 1 of a condenser with an insert 2. The insert 2 has an encircling sealing lip 3 which is arranged between the two flow transfer openings 4, 5 and which bears sealingly against the inner wall 6 of the tubular collector 1. Above and/or on one side of the sealing lip 3 as viewed in an axial direction, the insert 2 is of tubular form and has a fluid duct 7 which is formed by the tubular element 8 radially within the tubular element 8. Arranged radially outside the tubular element 8 is a fluid diverting element 9 by means of which the fluid stream 10 which flows into the collector 1 through the flow transfer opening 5 is diverted from the radial inflow direction into an axial direction.

Below and/or on the other side of the sealing lip 3, the insert 2 has a filter 11 which is for example of mesh-like form. At the lower end of the insert 2 there is provided a closure 12 of the tubular element 8 and/or of the filter 11. The closure 12 is for example formed integrally, as a plate, with the filter 11, and may alternatively also be in the form of a filter element.

Furthermore, the insert 2 has a supporting structure which is formed by struts 13 which extend in an axial direction and which are connected to a connecting means 14. It is advantageous here for a number of struts 13 to be arranged so as to be distributed over the circumference of the insert 2, and for connecting means 14 to connect said struts at their axial end. On the connecting means 14, which may be configured as an open ring, as a cross or as a plate, there may be provided a vessel 15 which contains a drying agent 16. Here, the vessel 15 may be connected to the connecting means 14 and to the supporting structure. Alternatively, the vessel 15 is also formed as a component which is separate from the supporting structure and from the connecting means 14, such that the supporting structure merely bears the vessel 15 and/or holds said vessel spaced apart from the fluid duct 7.

The vessel 15 may preferably be formed as a plastics component and provided with a wall which is provided with openings such that the fluid can flow through the openings into the interior of the vessel 15 in order to be able to flow there around the drying agent 16 accommodated in the vessel 15. Alternatively, the vessel may also be in the form of a pouch which is formed for example from a plastics nonwoven material and which accommodates the dry material.

It can be seen in FIG. 1 that the fluid diverting element 9 has an arcuate contour 17 which extends in the manner of a fillet between the axially extending sealing lip 3 and the tubular element 8 of the fluid duct 7.

It is achieved in this way that the inflowing fluid, after flowing through the inlet-side flow transfer openings 5, is diverted from a radial inflow direction into an axial direction, and subsequently flows in the axial direction in the annular duct 18 before being diverted through approximately 90° in the region of the dryer vessel 15 and subsequently flowing in the axial direction through the fluid duct 7.

Figure 2:
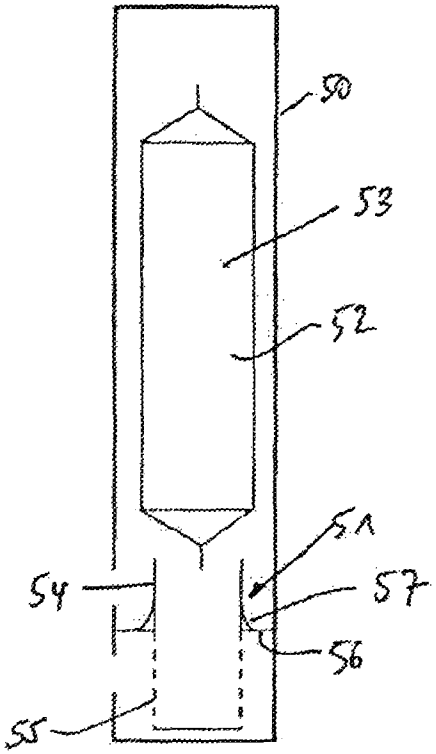
FIG. 2 shows a schematic view of a collector of a condenser with an insert.

FIG. 2 shows a further exemplary embodiment of the invention in which the insert 51 is arranged in the collector 50. The insert 51 is formed separately from the dryer vessel 52. The dryer vessel 52 is in the form of a pouch for accommodating the drying agent. The insert 51 has a tubular region 54 with an adjoining filter 55, wherein the sealing lip 56 is provided so as to protrude in the radial direction. The fluid diverting element is in the form of a fillet 57 or a curved region which approximately forms a quadrant between the sealing lip 56, which extends in the radial direction, and the tubular element, which extends in the axial direction.

Figure 3:
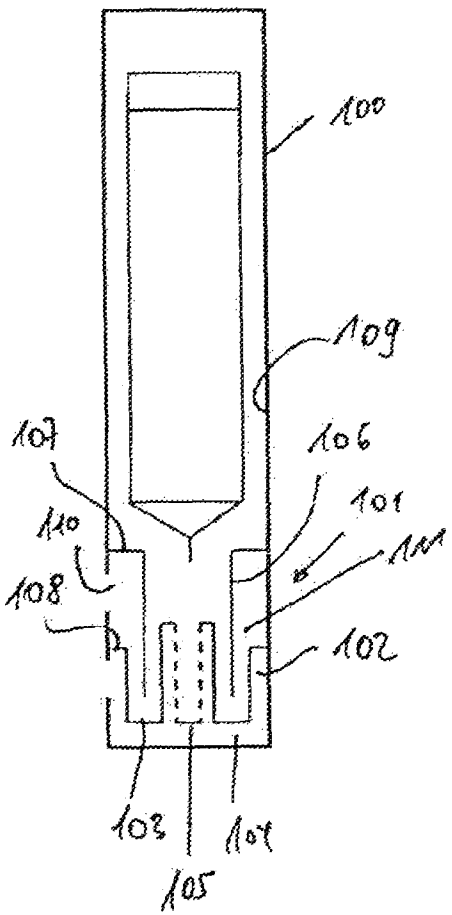
FIG. 3 shows a schematic view of a collector of a condenser with an insert.

FIG. 3 shows a further exemplary embodiment of the invention in which an insert 101 which is of meandering form is arranged in the collector 100. For this purpose, a first element 102 is provided which has two U-shaped regions 103, 104 which are arranged adjacent to one another in the radial direction and which between them accommodate a U-shaped filter region 105. A further tubular element 106 is provided which engages into the two U-shaped regions 103, 104 in the axial direction. Both the tubular element 106 and also the two U-shaped regions 103, 104 are sealed off against the inner wall 109 of the collector 100 by means of radial sealing lips 107, 108. This arrangement of the insert 101 has the effect that the fluid flowing in through the opening 110 flows in in a U-shaped flow duct 111, the fluid firstly being diverted from the radial direction into the axial direction and subsequently being diverted again through 180°, before the fluid can flow through the filter 105 after undergoing a further diversion through 180°.

Figure 5:
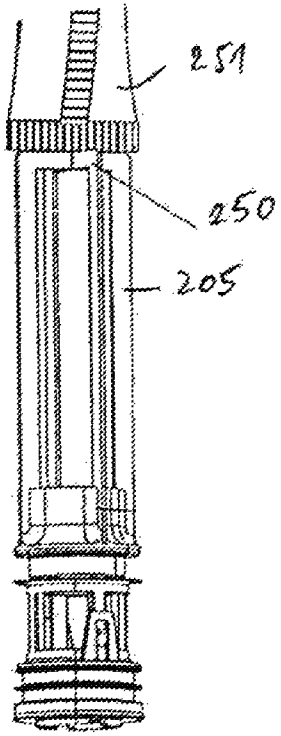
FIG. 5 is a schematic illustration of an insert.
Figure 4:
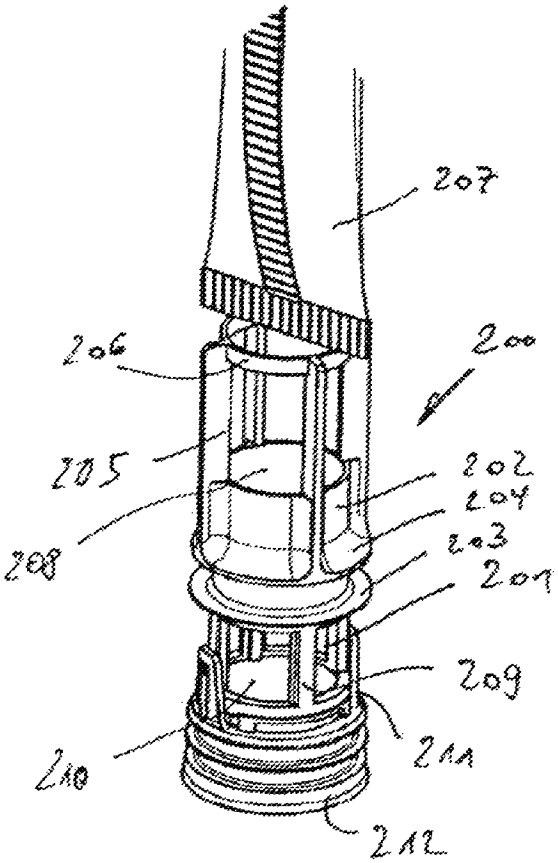
FIG. 4 is a schematic illustration of the insert.

FIGS. 4 and 5 show exemplary embodiments of an insert 200 with a filter element 201 which is spaced apart from the fluid duct 202 by the sealing lip 203. The fluid diverting elements 204 are formed, as arcuate, quadrant-like diverting elements, in the region of the fluid duct 202. Said diverting elements extend around the tubular element 202 which forms the fluid duct. On the tubular element, which forms the fluid duct 202, there are provided struts 205 which extend in the axial direction and which, at their axial end regions, are connected to one another by way of an annular connecting means 206 so as to provide a stable supporting structure for the vessel 207 for the drying agent. Between the struts 205 there are provided windows 208 through which the fluid can flow from radially outside to radially inside in order to subsequently flow through the fluid duct 202 radially within the tubular element 202. The filter 201 has a grid-like structure 209 which likewise has windows 210 which are covered by a fine-mesh filter material. It can also be seen that the filter may be arranged on a closure plug 212 by way of retention means 211 in order to connect the insert 200 to the closure plug 212 in a form-fitting manner, in order that the insert 200 may be inserted integrally with the closure plug 212 into the collector of the condenser.

FIG. 5 shows a further exemplary embodiment of the insert according to the invention, wherein the insert of FIG. 5 corresponds substantially to the insert of FIG. 4, wherein the struts 205 in the exemplary embodiment of FIG. 5 are connected at their axial end not by means of an annular region but rather by means of a cross-shaped region 250. The ends of the struts 205, angled substantially through 90°, thus run radially inward and converge on one another there, wherein said ends are cohesively connected to one another or formed integrally with one another there. It can also be seen that the length of the struts 205 of FIG. 5 differs from the length of the struts 205 of FIG. 4, but aside from that the two inserts 200 are of substantially identical form. The cross-shaped element 250 thus forms, together with the struts 205, the supporting structure for supporting the vessel 251 which contains the drying agent.

Figure 6:
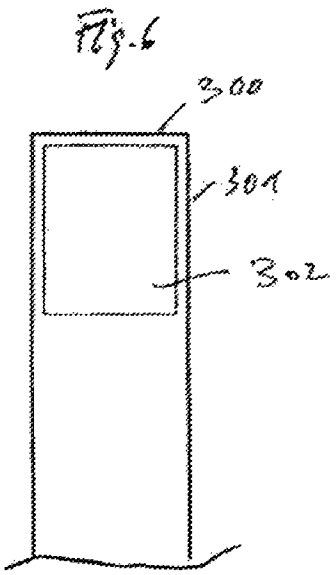
FIG. 6 shows a schematic partial view of a collector.

FIG. 6 schematically shows an end region 301 of a collector 300, wherein the vessel 302 for accommodating the drying agent is arranged at the end region of the collector 300 and does not have a direct connection to the insert, which is not illustrated in FIG. 6.

Figure 8:
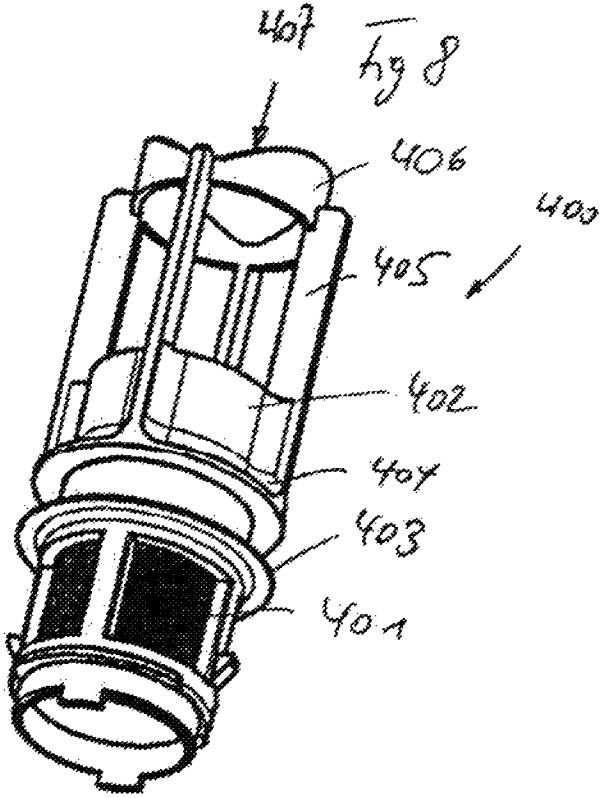
FIG. 8 is a schematic illustration of the insert as per FIG. 7 in a different perspective illustration.
Figure 7:
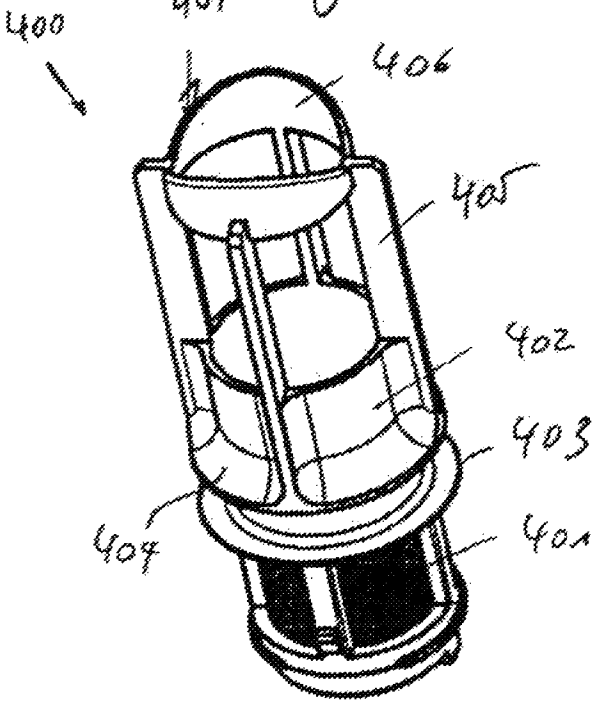
FIG. 7 is a schematic illustration of an insert.

FIGS. 7 and 8 show a further exemplary embodiment of an insert 400 with a filter element 401 which is spaced apart from the fluid duct 402 by the sealing lip 403. The fluid diverting elements 404 are formed, as arcuate, quadrant-like diverting elements, in the region of the fluid duct 402. Said diverting elements extend, similarly to those in FIGS. 4 and 5, around the tubular element which forms the fluid duct 402. On the tubular element, which forms the fluid duct 202, there are provided struts 205 which extend in the axial direction and which, at their axial end regions, are connected to one another by way of an annular connecting means 406 so as to provide a stable supporting structure for a vessel for the drying agent.

Here, the connecting element, in this case an annular connecting element, is formed with a modulation so as not to have a height which is uniform as viewed over the circumference; instead, the height of the annular element as a connecting means 406 is modulated such that the height exhibits a minimum at two mutually opposite points, and at this point runs to a minimum in a V-shaped manner. The annular element is thus composed substantially of two semi-circular elements which are curved in an arcuate manner on their axial face side and which converge at the minima.

This yields a type of ramp for the dryer vessel, such that the dryer vessel would move along the ramp 407 in the direction of the local minimum if it were moved out of the minimum position. The vessel would thus slide along the annular element in the circumferential direction and at the same time slide to the V-shaped minimum. A specified direction for the dryer vessel is defined in this way, such that the dryer would repeatedly pass into the same position with the same orientation.

The invention claimed is:

1. An insert for a collector of a condenser comprising:

a main body with a sealing lip for abutment against an inner wall of the collector axially between two flow transfer openings of the collector, a filter element for a fluid to flow through, a fluid diverting element, and a fluid duct such that the fluid diverting element diverts a radially inflowing fluid stream into an axially flowing fluid stream, wherein the fluid duct conducts said axially flowing fluid stream to the filter element, wherein the fluid diverting element is in the form of a tubular element which diverts the radially inflowing fluid stream by way of its outer circumference and which forms the fluid duct in a radially inner region of the tubular element.

2. The insert according to claim 1, wherein the fluid stream flows in a different direction radially at the outside at the tubular element than radially at the inside in the tubular element.

3. The insert according to claim 1, wherein the fluid diverting element is in the form of a tubular element, wherein, on the tubular element, on an outer circumference thereof, there is provided a contour, which is of arcuate section, for flow diversion.

4. The insert according to claim 1, wherein the fluid diverting element is in the form of a tubular element, wherein the insert also has a supporting structure which bears a dryer vessel.

5. The insert according to claim 4, wherein the supporting structure is formed by struts which protrude from the tubular element in an axial direction and which are connected by a connecting device.

6. The insert according to claim 5, wherein the connecting device is an open ring, a cross or a plate.

7. The insert according to claim 5, wherein the connecting device has, in an axial direction, a modulation which has two opposite minima.

8. The insert according to claim 4, wherein the insert can be or is connected to a closure plug of the collector.

9. A condenser having comprising:

a tube-fin block with tubes and fins, and collecting pipes arranged at both sides of the tube-fin block, wherein tube ends of the tubes are received in a sealed manner in openings of collecting tubes, wherein a collector is arranged adjacent to one of the collecting tubes, and the collector is fluidically connected to the adjacent collecting tube via flow transfer openings, wherein an insert according to claim 1 is arranged in the collector.

10. The condenser according to claim 9, wherein a vessel with a drying agent is arranged in the collector.

* * * * *